US009425034B2

(12) United States Patent
Verentchikov et al.

(10) Patent No.: US 9,425,034 B2
(45) Date of Patent: Aug. 23, 2016

(54) QUASI-PLANAR MULTI-REFLECTING TIME-OF-FLIGHT MASS SPECTROMETER

(75) Inventors: Anatoli N. Verentchikov, St. Petersburg (RU); Mikhail I. Yavor, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 13/054,728

(22) PCT Filed: Jul. 16, 2008

(86) PCT No.: PCT/US2008/070181

§ 371 (c)(1), (2), (4) Date: Apr. 21, 2011

(87) PCT Pub. No.: WO2010/008386

PCT Pub. Date: Jan. 21, 2010

(65) Prior Publication Data

US 2011/0186729 A1 Aug. 4, 2011

(51) Int. Cl.
*H01J 49/00* (2006.01)
*H01J 49/40* (2006.01)

(52) U.S. Cl.
CPC ..... *H01J 49/406* (2013.01)

(58) Field of Classification Search
CPC ..... H01J 49/40; H01J 49/405; H01J 49/406
USPC ..... 250/281, 282, 286, 287
See application file for complete search history.

(56) References Cited

U.S. PATENT DOCUMENTS 4,072,862 A 2/1978 Mamyrin et al.
5,017,780 A 5/1991 Kutscher et al.
7,326,925 B2 2/2008 Verentchikov et al.
7,385,187 B2 6/2008 Verentchikov et al.
7,982,184 B2 * 7/2011 Sudakov ..... H01J 49/406 250/287

(Continued)

FOREIGN PATENT DOCUMENTS

CN 2622854 Y 6/2004
GB 2080021 1/1982

(Continued)

OTHER PUBLICATIONS

Mamyrin et al., *Sov. J. Tech. Phys.* 41 (1971) 1498.

(Continued)

*Primary Examiner* — Nicole Ippolito
*Assistant Examiner* — Jason McCormack
(74) *Attorney, Agent, or Firm* — Honigman Miller Schwartz and Cohn LLP

(57) ABSTRACT

A multi-reflecting time-of-flight (MR-TOF) mass spectrometer, which includes two quasi-planar electrostatic ion mirrors extended along drift direction (Z) and is formed of parallel electrodes, separated by a field-free region. The MR-TOF includes a pulsed ion source to release ion packets at a small angle to X-direction which is orthogonal to the drift direction Z. Ion packets are reflected between ion mirrors and drift along the drift direction. The mirrors are arranged to provide time-of-flight focusing ion packets on the receiver. The MR-TOF mirrors provide spatial focusing in the Y-direction orthogonal to both drift direction Z and ion injection direction X. In a preferred embodiment, at least one mirror has a feature providing periodic spatial focusing of ion packets in the drift Z-direction.

27 Claims, 7 Drawing Sheets

(56) References Cited

U.S. PATENT DOCUMENTS

| | | | | |
|---|---|---|---|---|
| 2001/0011703 | A1 | 8/2001 | Franzen | |
| 2005/0242279 | A1* | 11/2005 | Verentchikov | 250/287 |
| 2006/0214100 | A1* | 9/2006 | Verentchikov | H01J 49/406 250/287 |
| 2007/0029473 | A1* | 2/2007 | Verentchikov | H01J 49/406 250/281 |
| 2007/0158545 | A1* | 7/2007 | Verentchikov | 250/282 |
| 2007/0176090 | A1* | 8/2007 | Verentchikov | 250/287 |
| 2007/0187585 | A1* | 8/2007 | Verentchikov | 250/287 |
| 2008/0272293 | A1* | 11/2008 | Vestal | H01J 49/164 250/288 |
| 2010/0044558 | A1* | 2/2010 | Sudakov | 250/281 |
| 2010/0051799 | A1* | 3/2010 | Makarov | 250/282 |
| 2010/0193682 | A1* | 8/2010 | Golikov et al. | 250/287 |

FOREIGN PATENT DOCUMENTS

| | | | |
|---|---|---|---|
| JP | 2007526596 | A | 9/2007 |
| JP | 2008535164 | A | 8/2008 |
| JP | 2009512162 | A | 3/2009 |
| JP | 2011507205 | A | 3/2011 |
| SU | 1681340 | | 9/1991 |
| SU | 1725289 | | 4/1992 |
| WO | 04008481 | | 1/2004 |
| WO | 05001878 | | 1/2005 |
| WO | 06102430 | | 9/2006 |
| WO | 07044696 | | 4/2007 |
| WO | WO 2007044696 | A1 * | 4/2007 |
| WO | 2008047891 | A2 | 4/2008 |

OTHER PUBLICATIONS

Toyoda, Michisato et al., "Multi-turn time-of-flight mass spectrometers with electrostatic sectors," *J. Mass Spectrom.,* 2003, 38, 1125-1142.

Satoh, Takaya et al., "The Design and Characteristic Features of a New Time-of-Flight. Mass Spectrometer with a Spiral Ton Trajectory," *Am. Society for Mass. Spectrometry,* 2005.

Wollnik, H., "Time-of-flight Mass Analyzers," *Mass Spectrometry Reviews,* 12, 1993, pp. 89-114.

Wollnik, H. et al., "An energy-isochronous multi-pass time-of-flight mass spectrometer consisting of two coaxial electrostatic mirrors," *Int. Journal of Mass Spectrometry,* 227, 2003, pp. 217-222.

English translation of Japanese Office Action for related Application No. 2011-518694 dated Feb. 12, 2014.

* cited by examiner

QUASI-PLANAR MULTI-REFLECTING TIME-OF-FLIGHT MASS SPECTROMETER

CLAIM OF PRIORITY

Filed under 35 U.S.C. §371, this application constitutes a 371 application of International Application No. PCT/US2008/070181 filed on Jul. 16, 2008. The contents of that international application are incorporated herein in their entirety.

BACKGROUND OF THE INVENTION

This invention generally relates to mass spectroscopic analysis and, more particularly, an apparatus including a multi-reflecting time-of-flight mass spectrometer (MR-TOF MS) and a method of use.

Mass spectrometry is a well-recognized tool of analytical chemistry, used for identification and quantitative analysis of various compounds and their mixtures. Sensitivity and resolution of such analysis is an important concern for practical use. It has been well recognized that resolution of time-of-flight mass spectrometers (TOF MS) improves with flight path. Multi-reflecting time-of-flight mass spectrometers (MR-TOF MS) have been proposed to increase the flight path while keeping moderate physical length. The use of MR-TOF MS became possible after introduction of an electrostatic ion mirror with time-of-flight focusing properties. U.S. Pat. No. 4,072,862, Soviet Patent No. SU1681340, and Sov. J. Tech. Phys. 41 (1971) 1498, Mamyrin et. al. disclose the use of an ion mirror for improving time-of-flight focusing with respect to ion energy. The use of an ion mirror automatically causes a single folding of ion flight path.

H. Wollnik realized a potential of ion mirrors for implementing a multi-reflecting MR-TOF MS. UK Patent No. GB2080021 suggests reducing the full length of the instrument by folding the ion path between multiple gridless mirrors. Each mirror is made of coaxial electrodes. Two rows of such mirrors are either aligned in the same plane or located on two opposite parallel circles (see FIG. 1). Introduction of gridless ion mirrors with spatial ion focusing reduces ion losses and keeps the ion beam confined regardless of number of reflections (see U.S. Pat. No. 5,017,780 for more details). The gridless mirrors disclosed in UK Patent No. GB2080021 also provide "'independence of ion flight time from the ion energy'." Two types of MR-TOF MS are disclosed:

(A) "folded path" scheme, which is equivalent to combining N sequential reflecting TOF MS, and where the flight path is folded along a jigsaw trajectory (FIG. 1A); and (B) "coaxial reflecting" scheme, which employs multiple ion reflections between two axially aligned ion mirrors using pulsed ion admission and release (FIG. 1B).

The "coaxial reflecting" scheme is also described by H. Wollnik et al. in Mass Spec. Rev., 1993, 12, p. 109 and is implemented in the work published in the Int. J. Mass Spectrom. Ion Proc. 227 (2003) 217. Resolution of 50,000 is achieved after 50 turns in a moderate size (30 cm) TOF MS. Gridless and spatially focusing ion mirrors preserve ions of interest (losses are below a factor of 2), although the mass range shrinks proportionally with a number of cycles.

MR-TOF mass spectrometers have also been designed with using sector fields instead of ion mirrors (Toyoda et al., J. Mass Spectrometry, 38 (2003), 1125; Satoh et al., J. Am. Soc. Mass Spectrom., 16 (2005), 1969). However, these mass analyzers, unlike those based on ion mirrors, provide for only first-order energy focusing of the flight time.

Soviet Patent No. SU1725289 by Nazarenko et al. (1989) introduces an advanced scheme of a folded path MR-TOF MS, using two-dimensional gridless mirrors. The MR-TOF MS comprises two identical mirrors, built of bars, parallel and symmetric with respect to the median plane between the mirrors and also to the plane of the folded ion path (see FIG. 2). Mirror geometry and potentials are arranged to focus the ion beam spatially across the plane of the folded ion path and to provide second-order time-of-flight focusing with respect to ion energy. The ions experience multiple reflections between planar mirrors, while slowly drifting towards the detector in a so-called shift direction (the Z axis in FIG. 2). The number of cycles and resolution are adjusted by varying an ion injection angle. The scheme allows the retention of full mass range while extending the flight path.

However, the planar mass spectrometer by Nazarenko provides no ion focusing in the shift direction, thus, essentially limiting the number of reflection cycles. Besides, the ion mirrors used in the prototype do not provide time-of-flight focusing with respect to spatial ion spread across the plane of the folded ion path so that use of diverging or wide beams would in fact ruin the time-of-flight resolution and make an extension of flight path pointless.

In U.S. Pat. No. 7,385,187, filed Dec. 20, 2005, entitled Multi-Reflecting Time-of-Flight Mass Spectrometer and Method of Use, the planar scheme of multi-reflecting mass spectrometer is improved by:

a) introducing an ion mirror which provides spatial focusing in the vertical direction, high order spatial and energy focusing while staying isochronous to a high order of spatial and energy aberrations;
b) introducing a set of periodic lenses in the field-free region, where such a lens system retains ion packets along the main jigsaw ion path; and
c) introducing end deflectors, which allow further extension of the ion flight path by reverting the ion motion in the drift direction.

Further improvements of planar multi-reflecting TOF MS were made in the following applications by the inventors: WO2006102430, WO2007044696, and WO2004008481.

These applications describe multiple pulsed ion sources including various schemes of ion accumulation and conversion of continuous ion beams into short ion packets. WO2006102430 suggests a curved isochronous interface for ion injection from external pulsed ion sources into the analyzer. The interface allows bypassing fringing fields of the analyzer and this way improves resolution of the instrument. The curved interface is compatible with trap ion sources and with the pulsed converter based on orthogonal ion acceleration.

WO2007044696 suggests a so-called double orthogonal injection of ions into the MR-TOF. Accounting that the MR-TOF analyzer is much more tolerant to vertical Y-spread of ion packets, a continuous ion beam is oriented nearly orthogonal to the plane of jigsaw ion trajectory in MR-TOF. The accelerator is slightly tilted and ion packets are steered after acceleration such that to mutually compensate for tilting and steering.

WO2004008481 applies an MR-TOF analyzer to various tandems of TOF MS. One scheme employs slow separation of parent ions in the first MR-TOF and rapid analysis of fragment ions in the second short TOF MS to accomplish so-called parallel MS-MS analysis for multiple parent ions within one shot of the pulsed ion source.

WO2005001878 is considered a prototype of the present invention, since it employs "folded path" MR-TOF MS with planar gridless mirrors, having spatial and time-of-flight focusing properties.

While implementing planar multi-reflecting mass spectrometers, the inventors discovered that the system of periodic lens commonly interferes with ion injection interface and pulsed ion sources. Also, the lens system sets the major limitation onto acceptance of the analyzer. The goal of the present invention is to improve sensitivity and resolution of multi-reflecting mass spectrometers as well as to improve convenience of their making.

SUMMARY OF THE INVENTION

The inventors have realized that acceptance and resolution of MR-TOF MS with substantially two-dimensional planar mirrors could be further improved by introducing a periodic spatial modulation of the electrostatic field of ion mirrors in the drift direction. As the field of the ion mirrors remains almost planar, a spectrometer in which small periodic modulation to the mirror field is added is called quasi-planar.

The preferred embodiment of the invention is a multi-reflecting time-of-flight mass spectrometer including one or more of the following features:

- two quasi-planar electrostatic ion mirrors extended along a drift direction (Z) and formed of parallel electrodes, said mirrors are separated by a field-free region;
- a pulsed ion source to release ion packets at a small angle to the X direction which is orthogonal to the drift direction Z, such that ion packets are reflected between ion mirrors and drift along the drift direction;
- a receiver to receive ion packets;
- the said mirrors are arranged such that to provide time-of-flight focusing on the receiver;
- the said mirrors are arranged such that to provide spatial focusing in the Y-direction orthogonal to both drift direction Z and ion injection direction X, wherein at least one mirror has a periodic feature providing modulation of an electrostatic field along the drift Z-direction for the purpose of periodic spatial focusing of ion packets in the Z-direction.

As described by the inventors in WO2005001878, ion mirrors preferably comprise at least four electrodes with at least one electrode having attracting potential to provide time-of-flight focusing and said spatial in Y-direction focusing. The apparatus optionally incorporates the earlier described in WO2005001878 features of planar multi-reflecting mass spectrometers such as:

- at least two lenses in the field-free region,
- an end deflector for reverting ion path in the drift direction,
- at least one isochronous curved interface between said pulsed ion source and said receiver.

The periodic modulation in the Z-direction of an electrostatic field within an ion mirror is achieved by:

- Incorporating at least one auxiliary electrode with a Z-periodic geometric structure into at least one mirror electrode, wherein a tunable potential is applied to this electrode or a set of electrodes to adjust the strength of modulation in the Z-direction;
- Making a set of periodic slots in at least one of the mirror electrodes, while adding an additional electrode whose field penetrates through those slots;
- Inserting at least one auxiliary electrode having a Z-periodic geometric structure between the mirror electrodes;
- Modifying geometry of at least one mirror electrode such that the electrode opening is periodically (with Z) varied in height (Y-direction) or the electrode is periodically varied in width (along the X direction);
- Incorporating a set of periodic lenses into the internal electrode of at least one ion mirror or between the mirror electrodes;
- Multiple other ways of field modulation are possible. Solutions with adjustable strength of Z-periodic modulation are preferred to solutions with fixed geometric modulation.

The spectrometer preferably also incorporates features earlier described in patent applications: WO2005001878, WO2006102430, WO2007044696, and WO2004008481, the disclosures of these applications are incorporated herein by reference.

The preferred method of time-of-flight analysis of the invention comprising the following steps:

- forming packets of analyzed ions;
- passing ions between two parallel and quasi-planar ion mirrors extended along the drift Z-direction while retaining a relatively small velocity component of ion packets along the Z-direction such that ions move along a jigsaw ion trajectory;
- receiving ions at a receiver;
- forming an electrostatic field with said ion mirrors such that ions are focused in time and spatially focused in one direction Y, this field being periodically spatially modulated in the Z-direction within at least one mirror in order to provide for spatial focusing of ion packets along the Z-direction.

The method further optionally comprises the steps described in WO2005001878, namely:

- spatial focusing of ion packets within a drift space between ion mirrors by at least two lenses; reverting direction of ion drift at the edges of the analyzer;
- ion injection via a curved isochronous interface.

A step of periodic modulating an electrostatic field within at least one ion mirror comprises either one of:

- spatial modulation of the shape of at least one mirror electrode, or
- introducing a periodic field by the incorporation of auxiliary electrodes, where the strength of periodic focusing is preferably adjustable.

The period of said modulation preferably equals $N\Delta Z/2$ or $N\Delta Z$, where N is an integer number and $\Delta Z$ is an ion trajectory advance in the drift direction per reflection in one mirror.

According to one embodiment of the present invention, the sensitivity and resolution of multi-reflecting mass spectrometers (MR MS) is improved.

According to another embodiment of the present invention, the manufacturing of a MR MS is facilitated.

These and other features, advantages, and objects of the present invention will be further understood and appreciated by those skilled in the art by reference to the following specification, claims, and appended drawings.

DETAILED DESCRIPTION OF THE EMBODIMENTS

The present invention relates generally to the area of mass-spectroscopic analysis and, more particularly, is concerned with the apparatus, including a multi-reflecting time-of-flight mass spectrometer (MR TOF MS). Specifically, the invention improves resolution and sensitivity of a planar and gridless MR-TOF MS by incorporating a slight periodic modulation of the mirror electrostatic field. Because of improved spatial and time focusing, the MR-TOF MS of the invention has a wider acceptance and a confident confinement of the ion beam along an extended folded ion path. As a result, the MR-TOF MS of the invention can be efficiently coupled to continuous ion sources via an ion storage device, thus saving on duty cycle of ion sampling.

Figure 1A:
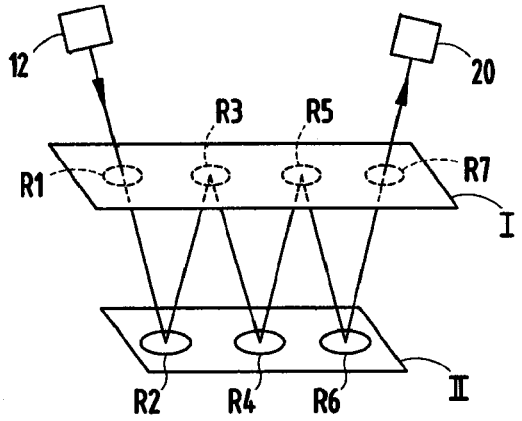
FIG. 1A (PRIOR ART)
FIGS. 1A and 1B show a prior art MR-TOF MS.
Figure 1B:
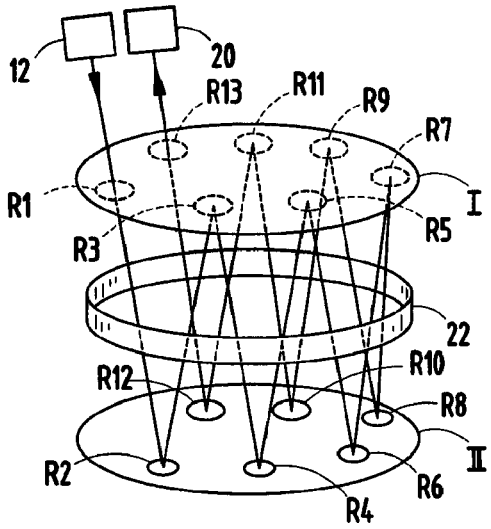
FIG. 1B (PRIOR ART)
Figure 3:
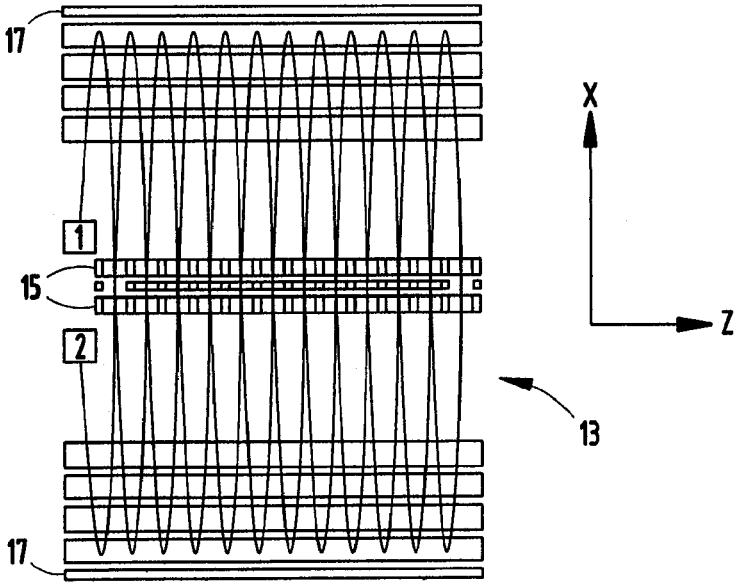
FIG. 3 (PRIOR ART)
FIG. 3 is a schematic view of a prior art planar MR-TOF MS with periodic lenses.
Figure 4A:
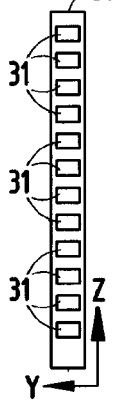
FIG. 4A is a top view of a preferred embodiment of a quasi-planar ion mirror with spatial field modulation achieved by a mask electrode located between two mirror electrodes.
Figure 4B:
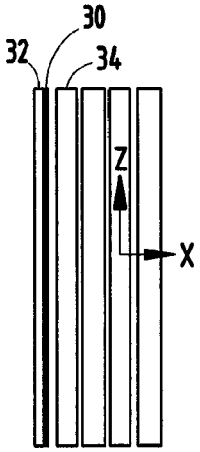
FIG. 4B is a side elevational view of the auxiliary electrode shown in FIG. 4A.
Figure 4C:
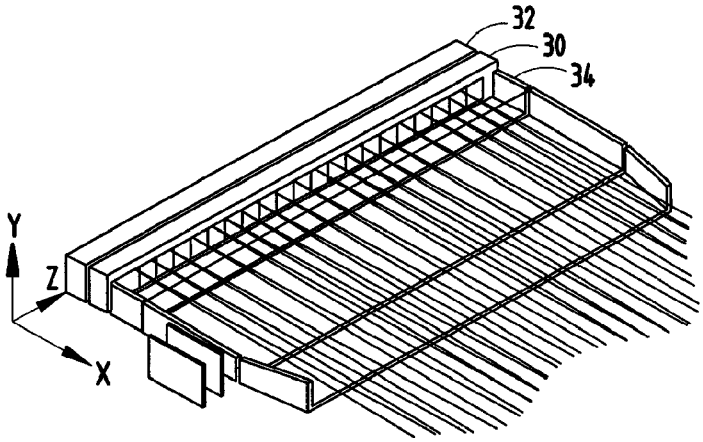
FIG. 4C is a perspective view of preferred embodiment of a quasi-planar ion mirror with spatial field modulation achieved by a mask electrode located between two mirror electrodes.
Figure 4D:
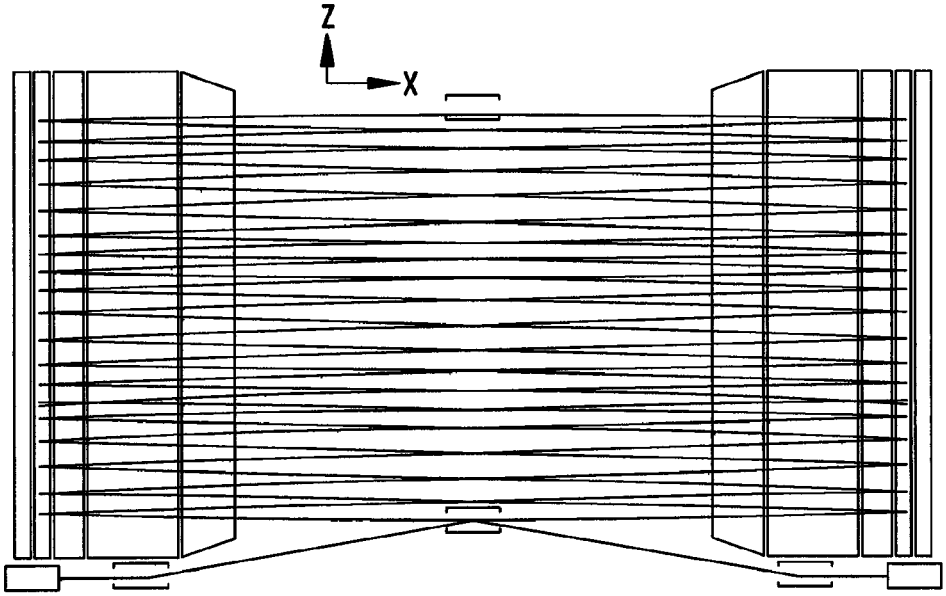
FIG. 4D is a top plan view of a preferred embodiment of a quasi-planar TOF MS with a stable confinement of a narrow ion beam with reverting Z-direction of ions by an end deflector.

FIGS. 1A and 1B show a MR-TOF MS of prior art, by Wollnik et al., GB Patent No. 2080021 (FIG. 3 and FIG. 4 of the GB patent). In a time-of-flight mass spectrometer ions of different masses and energies are emitted by a source 12. The flight path of ions to a collector 20 is folded by arranging for multiple reflections of the ions by mirrors R1, R2, . . . Rn. The mirrors are such that the ion flight time is independent of ion energy. FIGS. 1A and 1B show two geometrical arrangements of multiple axially symmetric ion mirrors. In both arrangements ion mirrors are located in two parallel planes I and II and are aligned along the surface of the ion path. In one arrangement, this surface is a plane (FIG. 1A) and in another one it is a cylinder 22 (FIG. 1B). Note that ions travel at an angle to the optical axis of the ion mirrors, which induces additional time-of-flight aberrations and thus considerably complicates achieving high resolution.

Figure 2:
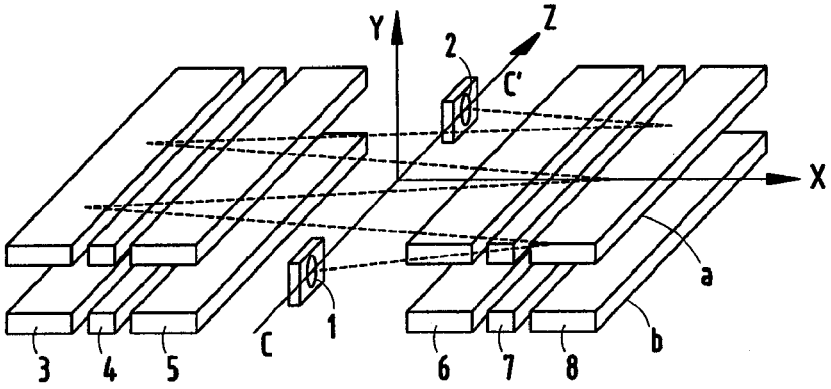
FIG. 2 (PRIOR ART)
FIG. 2 shows a prior art planar MR-TOF MS.

FIG. 2 shows a 'folded path' MR-TOF MS of a prototype by Nazarenko et al., described in Russian Patent No. SU1725289. The MR-TOF MS comprises two gridless electrostatic mirrors, each composed of three electrodes 3, 4 and 5 for one mirror, and 6, 7 and 8 for another mirror. Each electrode is made of a pair of parallel plates 'a' and 'b,' symmetric with respect to the 'central' plane XZ. A source 1 and receiver 2 are located in the drift space between the said ion mirrors. The mirrors provide multiple ion reflections. Number of reflections is adjusted by moving the ion source along the X-axis relative to the detector. The patent describes a type of ion focusing which is achieved on every ion turn, achieving a spatial ion focusing in the Y-direction and a second order time-of-flight focusing with respect to ion energy.

Note that the FIG. 2 structure provides no ion focusing in the shift direction (i.e., Z-axis), thus essentially limiting the number of reflection cycles. It also does not provide time-of-flight focusing with respect to spatial ion spread in the Y-direction. Therefore, the MR-TOF MS of the prototype fails in delivering wide acceptance of the analyzer and, thus, an ability of working with real ion sources.

FIG. 3 is a schematic view of a planar MR-TOF MS with prior art periodic lenses by the present inventors. The spectrometer comprises two parallel and planar ion mirrors. Each mirror is formed from four electrodes 11 having a shape of rectangular frames, substantially elongated in the drift Z-direction. Far away from the mirror Z-edges the electric field is planar, i.e. depends on X and Y, and is independent on Z. Mirrors are separated by a field-free region 13. A set of periodic lenses 15 is placed within the field-free region. Ions pulses are ejected from a source 1 at small angle $\alpha$ to the X-axis. Ion packets get reflected between mirrors while slowly drifting in Z-direction. The angle is selected such that the advance in Z-direction per reflection coincides with the period of the periodic lens. The lens enforces ion motion along the jigsaw trajectory. End-deflectors 17 allow reverting ion motion. The far-end deflector is set static. After passing the defector, ions are directed along another jigsaw trajectory towards the ion receiver 2, commonly a time-of-flight detector, such as microchannel plates (MCP) or secondary electron multiplier (SEM).

FIG. 4 shows one preferred embodiment of a quasi-planar MR-TOF MS of the present invention. In this embodiment, a periodic field structure in the Z-direction is formed by auxiliary electrodes 30 with periodic windows 31 (also denoted here as mask windows) located between two adjacent mirror electrodes 32 and 34, as shown in FIG. 4A-4C. The Y-height of the mask windows 31 is preferably equal to the Y-opening of the mirror electrodes. The spacing of the mask windows 31 in the Z-direction is equal to ΔZ ion advance per one mirror reflection and is comparable to Y-opening of ion mirrors. The potential applied to the mask electrodes is slightly different as compared to the middle potential between two adjacent mirror electrodes, so that a weak periodic focusing field is created in Z-direction. FIG. 4C shows trajectories of ions with realistic angular (0.4 deg) and energy spread (5%).

In operation (FIG. 4D), narrow ion bunches in the Z-direction are formed by a pulsed ion converter like a linear ion trap source or a double orthogonal injection device (WO2007044696, the disclosure of which is incorporated herein by reference). The latter forms ion packets extended in the Y-direction but which are narrow in the Z-direction. These ion bunches are injected into the time-of-flight analyzer with the aid of a set of defectors or a curved isochronous interface, such as disclosed in WO2006102430, the disclosure of which is incorporated herein by reference. The packets are ejected within the drawing plane and at a small angle to axis X, such that ion advance ΔZ per one reflection in the mirror coincides with the period of spatial modulation of the electric field in the ion mirror. Inside the analyzer, ions move along jigsaw trajectories being periodically reflected by the ion mirrors 34 which provide for time focusing as well as for spatial focusing in the Y-direction. Passing through mask electrodes 30, ions are focused by a periodic field in the Z-direction. The preferable focal length of mask electrode lenses in the X-direction is equals to a half period of the jigsaw motion. After reaching the end of the analyzer, ions are preferably turned back either by a deflector, such as disclosed in WO2005001878, the disclosure of which is incorporated herein by reference. Alternatively, the drift direction of ion packets is reverted by a deflector incorporated into the ion mirror as described below. Ions, after passing through the analyzer (forth and back in Z-direction), are ejected onto the detector or another receiver with the aid of a set of deflectors or a curved isochronous interface.

Figure 5:
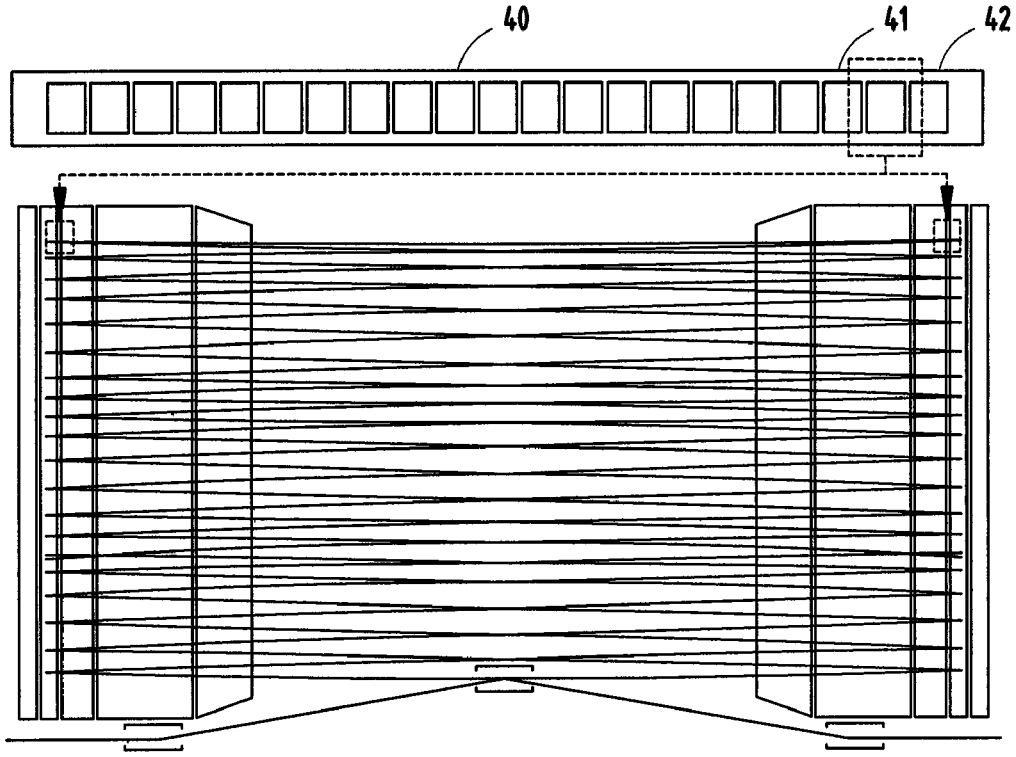
FIG. 5 is a top plan view of a preferred embodiment of the quasi-planar TOF MS with reverting Z-direction of ions by a deflecting field created by mask electrodes split into several parts with different potentials.

FIG. 5 shows an alternative way of reflecting an ion in the Z-direction after reaching the far end (in Z-direction) of the analyzer. The ion mirror structure of the FIG. 5 embodiment is generally similar to the FIGS. 4A-4C embodiment with the following noted difference. Reflection is performed by a weak deflecting field created by the end mask window 40 split into two parts 41, 42 with a different potential applied to the end part of the window. In general, cutting the mask into multiple parts and applying slightly different potentials to these parts allows gradually changing the drift angle within the analyzer.

Figure 6A:
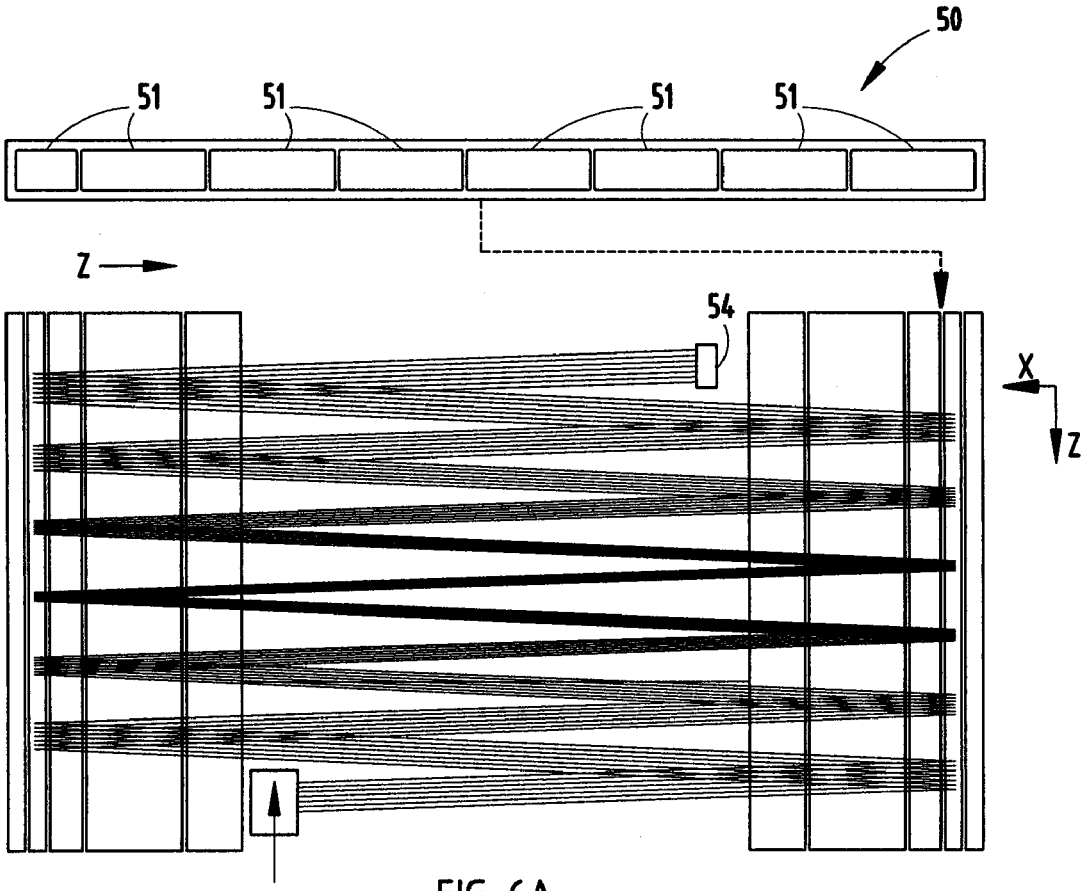
FIG. 6A is a plan view illustrating an initially parallel ion beam, created by an orthogonal accelerator and elongated in the Z-direction, in another preferred embodiment of a quasi-planar TOF MS with Z-focusing of ion bunches with the aid of a periodic mask electrode embedded into one ion mirror.
Figure 6B:
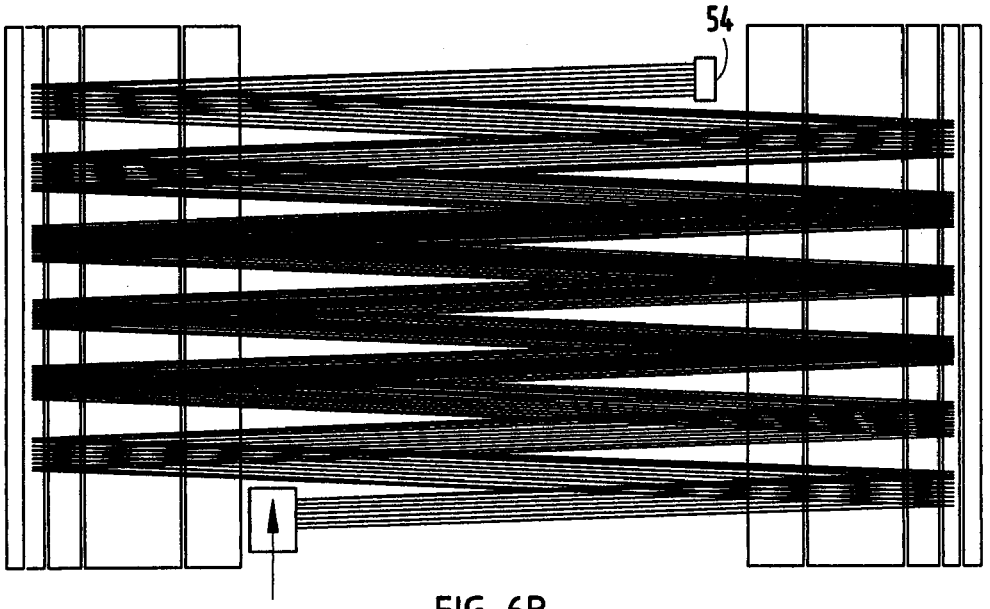
FIG. 6B is a plan view illustrating the transport of an ion beam, created by an orthogonal accelerator, elongated in the Z-direction and having realistic angular and energy spread, in a quasi-planar TOF MS with Z-focusing of ion bunches with the aid of a periodic mask electrode embedded into one ion mirror.

FIGS. 6A and 6B show another option of the preferred embodiment wherein the analyzer tolerates ion packets which are long in the Z-direction. Again, ion focusing in the Z-direction is performed by the auxiliary electrodes 50 with periodic windows 51. However, in this case, the size of the mask windows 51 is essentially larger compared to the Y-window of mirror electrodes. Ion bunches elongated in the Z-direction are formed by an orthogonal accelerator positioned between the mirrors. After acceleration, ion packets move along the jigsaw path. Preferably, the mask is implemented within one mirror only and the step of the mask windows is equal to the period 2ΔZ of the ion motion in the Z-direction, as shown in FIG. 6. Alternatively, masks are implemented at both mirrors, as in FIG. 4, and the position of the windows in the masks in opposite mirrors is shifted in the Z-direction by ΔZ. After passing through the analyzer, ions are received by a detector 54. The potential at the mask(s) is preferably adjusted to provide for the initially parallel mono-energetic ion beam after several reflections, for example, at half of the flight path length as shown in FIG. 6A. The optimal adjustment of the potential compromises small time-of-flight aberrations caused by the mask and confinement of ions with a realistic angular and energy spread along all the flight path, as shown in FIG. 6B.

Figure 7A:
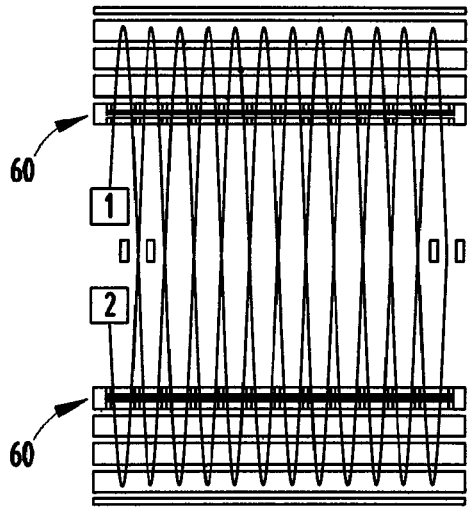
FIG. 7A is a schematic view of an embodiment of quasi-planar MR-TOF MS of the invention, with lenses being formed by additional electrodes incorporated into ion mirror electrodes and having the period of half of the period of ion jigsaw motion.
Figure 7B:
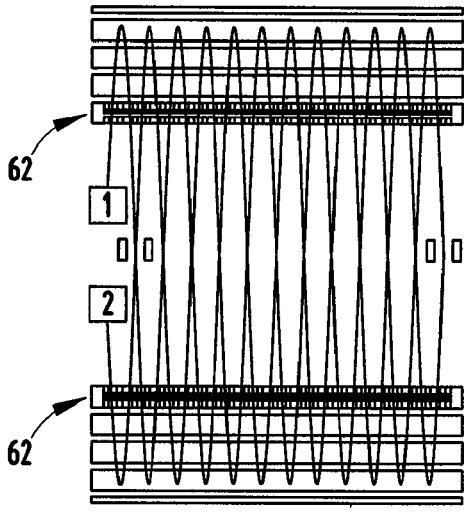
FIG. 7B is a schematic view of an embodiment of quasi-planar MR-TOF MS of the invention, with lenses being formed by additional electrodes incorporated into ion mirror electrodes and having the period of quarter of the period of ion jigsaw motion.

FIG. 7A shows a schematic of another embodiment of quasi-planar MR-TOF MS of the present invention, with periodic lenses 60 being formed by additional electrodes incorporated into ion mirror electrodes, here into the internal electrodes, next to field-free region. The lens period in FIG. 7A is equal to the half period of ion jigsaw motion (one lens per reflection). Alternatively, as shown in FIG. 7B, the period of the lenses 62 can be equal to a quarter of the period of the ion jigsaw motion (two lenses per reflection).

Figure 8A:
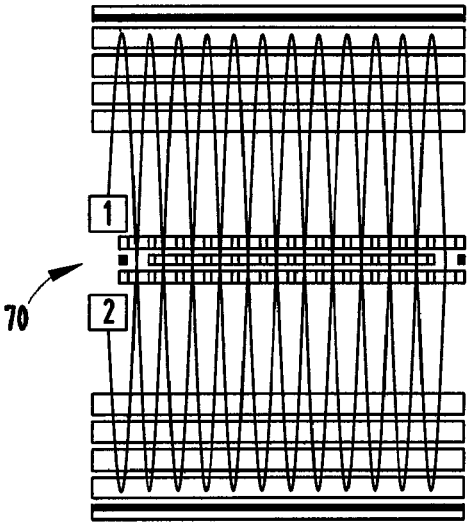
FIG. 8A is a schematic view of an embodiment in which a set of periodic lenses is added within the field-free region to further increase ion focusing in the Z-direction provided by additional electrodes located between the mirror electrodes.
Figure 8B:
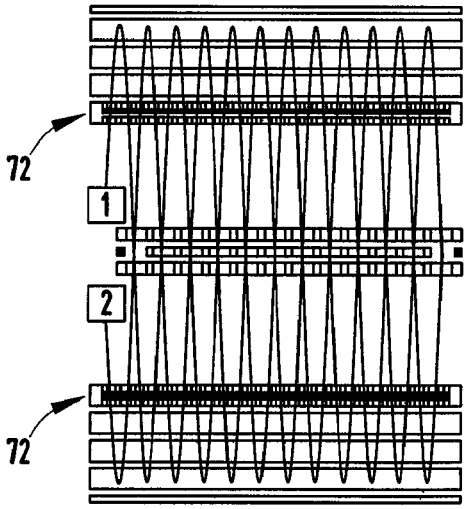
FIG. 8B is a schematic view of an embodiment in which a set of periodic lenses is added within the field-free region to further increase ion focusing in the Z-direction provided by additional electrodes implemented into the mirror electrodes.

FIG. 8 shows yet another embodiment in which a set of periodic lenses 70 is added within the field-free region to further increase ion focusing in the Z-direction provided by additional electrodes located either between the mirror electrodes, as in FIG. 8A, or implemented into the mirror electrodes 72, as in FIG. 8B. The set of periodic lenses in the field-free space can be replaced by a set of beam restricting masks which prevents hitting the detector by ions occasionally under-focused or over-focused by periodic fields of quasi-planar mirrors and thus coming to the detector after having a different number of reflections.

Figure 9A:
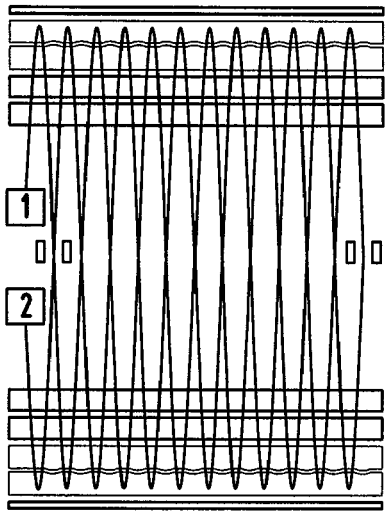
FIG. 9A is a schematic view of an embodiment in which the modulating electrostatic field of the ion mirror is achieved by geometrical modulation of at least one mirror electrode.
Figure 9B:
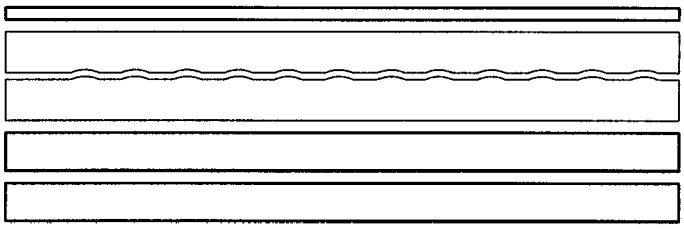
FIGS. 9B and 9C are schematic views showing the modulation of the electric field by periodically varying electrode thickness (9B) and by periodically varying window height (9C)
Figure 9C:
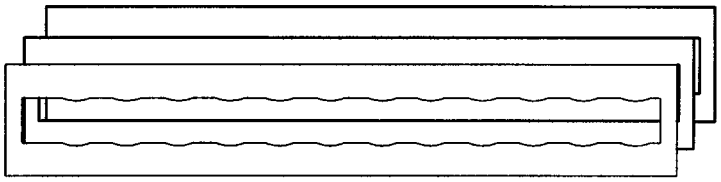

FIG. 9A shows yet another embodiment in which modulating the electrostatic field of the ion mirror is achieved by geometrical modulation of at least one mirror electrode. FIG. 9B shows modulation of the electric field by periodically varying electrode thickness. FIG. 9C shows modulation of the electric field by periodically varying window height. Since potentials of electrodes are fixed to provide best time-of-flight and spatial focusing, the geometrical modulation causes a fixed strength of ion focusing in the Z-direction for each chosen geometrical modulation. The strength of modulation should be chosen as a compromise between the acceptance and resolution of the analyzer.

Figure 10:
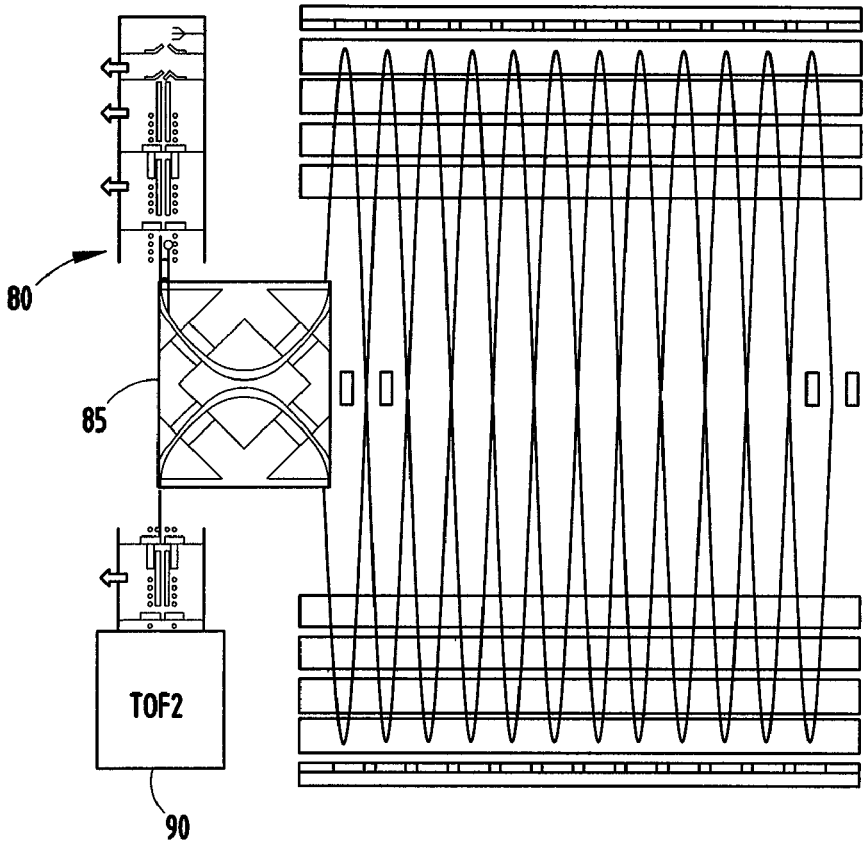
FIG. 10 is a schematic diagram showing a system with an external ion source made of an ion trap and an external collision cell followed by a second TOF mass analyzer.

FIG. 10 shows an arrangement with an external ion source made of ion trap 80 and with external collision cell followed by a second TOF mass analyzer 90. The external devices are coupled to MRT via an isochronous curved interface 85. Such arrangements of tandem TOF instruments are described in application WO2004008481.

The drawing presents several different setups described in prior applications by the present inventors. A single stage TOF MS employs an ion trap for accumulation of ions coming from continuous ion sources. Ion packets are ejected into the analyzer via curved field interface 85. After passing twice (forth and back) through the analyzer, ions pass through the second leg of the isochronous interface and impinge upon a common TOF detector (not shown in the drawing).

In the case of running the instrument as a high throughput tandem mass spectrometer, the detector is replaced by rapid collision cell, followed by a fast second TOF spectrometer. While parent ions are separated in time in the MR-TOF MS, the fragments are rapidly formed and analyzed for each ion species in a time. This allows so-called parallel MS-MS analysis for multiple parent ions without introducing additional ion losses, usually related to scanning in other types of tandem instruments.

In the case of running the instrument as a high resolution tandem, ions are periodically ejected from the axial trap into the MRT analyzer. A single ion species is time selected and gets injected back into the axial trap, this time working as a fragmentation cell. The fragments are collisional dampened in the gaseous cell and get ejected back into the same MRT analyzer for analysis of fragment masses.

The above description is considered that of the preferred embodiments only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

What is claimed is:

1. A multi-reflecting time-of-flight mass spectrometer comprising:

two electrostatic ion mirrors extended along a drift Z-direction and formed of parallel electrodes, wherein said ion mirrors are separated by a field-free region, wherein said parallel electrodes of at least one of said ion mirrors comprises an auxiliary electrode, and wherein said auxiliary electrode comprises a plurality of mask windows spaced along the drift Z-direction of the auxiliary electrode, each of the plurality of mask windows has a Z-directional length and a Y-directional height, and wherein the Z-directional length is larger than the Y-directional height;

a pulsed ion source to release ion packets into said field-free region at an angle to an X-direction which is orthogonal to the drift Z-direction, such that the ion packets are reflected between said ion mirrors and drift along the drift Z-direction; and a receiver to receive the ion packets;

wherein said ion mirrors are positioned to provide time-of-flight focusing on said receiver and to provide spatial focusing in a Y-direction orthogonal to both the drift Z-direction and the X-direction.

2. The apparatus as defined in claim 1, wherein at least one of said ion mirrors comprises at least four electrodes with at least one of said at least four electrodes having an attracting potential applied thereto to provide said time-of-flight focusing and said spatial focusing in the Y-direction.

3. A multi-reflecting time-of-flight mass spectrometer comprising:

two electrostatic ion mirrors extended along a drift Z-direction and formed of parallel electrodes, wherein said ion mirrors are separated by a field-free region;

a pulsed ion source to release ion packets into said field-free region at an angle to an X-direction which is orthogonal to the drift Z-direction, such that the ion packets are reflected between said ion mirrors and drift along the drift Z-direction; and a receiver to receive the ion packets, wherein said ion mirrors are positioned to provide time-of-flight focusing on said receiver and to provide spatial focusing in a Y-direction orthogonal to both the drift Z-direction and the X-direction, wherein at least one of said ion mirrors comprises a periodic feature providing modulation of electrostatic field along the drift Z-direction for the purpose of periodic spatial focusing of the ion packets in the drift Z-direction, wherein said periodic feature comprises an opening in at least one of said electrodes, and wherein said opening varies in height in the Y-direction.

4. A multi-reflecting time-of-flight mass spectrometer comprising:

two electrostatic ion mirrors extended along a drift Z-direction and formed of parallel electrodes, wherein said ion mirrors are separated by a field-free region;

a pulsed ion source to release ion packets into said field-free region at an angle to an X-direction which is orthogonal to the drift Z-direction, such that the ion packets are reflected between said ion mirrors and drift along the drift Z-direction; and a receiver to receive the ion packets, wherein said ion mirrors are positioned to provide time-of-flight focusing on said receiver and to provide spatial focusing in a Y-direction orthogonal to both the drift Z-direction and the X-direction, wherein at least one of said ion mirrors comprises a periodic feature providing modulation of electrostatic field along the drift Z-direction for the purpose of periodic spatial focusing of the ion packets in the drift Z-direction, and wherein said periodic feature comprises a varying width in the X-direction of at least one of said electrodes.

5. A multi-reflecting time-of-flight mass spectrometer comprising:

two electrostatic ion mirrors extended along a drift Z-direction and formed of parallel electrodes, wherein said ion mirrors are separated by a field-free region;

a pulsed ion source to release ion packets into said field-free region at an angle to an X-direction which is orthogonal to the drift Z-direction, such that the ion packets are reflected between said ion mirrors and drift along the drift Z-direction; and a receiver to receive the ion packets, wherein said ion mirrors are positioned to provide time-of-flight focusing on said receiver and to provide spatial focusing in a Y-direction orthogonal to both the drift Z-direction and the X-direction, wherein at least one of said ion mirrors comprises a periodic feature providing modulation of electrostatic field along the drift Z-direction for the purpose of periodic spatial focusing of the ion packets in the drift Z-direction, and wherein said periodic feature comprises a set of periodic lenses incorporated into at least one of said electrodes.

6. The apparatus as defined in claim 1, wherein said ion mirrors each comprise an auxiliary electrode, and wherein a potential of the auxiliary electrodes varies periodically in the Z-direction.

7. The apparatus as defined in claim 1, wherein said periodic feature has a period equal to integer number of trajectory periods of the ion packets.

8. The apparatus as defined in claim 1, wherein each of said two electrostatic ion mirrors comprises a quasi-planar electrostatic ion mirror.

9. The apparatus as defined in claim 1, wherein said periodic feature has a period equal to $N*\Delta Z/2$, where N is an integer and $\Delta Z$ is an advance of the ion packets in the drift Z-direction per reflection.

10. The apparatus as defined in claim 5, wherein said at least one of said electrodes comprises an internal electrode of said at least one of said mirrors, wherein said internal electrode resides at an X-directional edge of said at least one of said mirrors, and wherein said edge borders said field-free region.

11. A multi-reflecting time-of-flight mass spectrometer comprising:

two planar or quasi-planar electrostatic ion mirrors, each of said ion mirrors comprising a plurality of parallel electrodes extended along a Z-direction and each of said ion mirrors forming an electrostatic field;

a field-free region residing between said ion mirrors;

a pulsed ion source;

a receiver; and a periodic spatial modulation of at least one of said electrostatic fields of said ion mirrors in the Z-direction, wherein said pulsed ion source releases ion packets into said field-free region, wherein the ion packets travel through said field-free region along a jigsaw trajectory formed by said ion mirrors reflecting the ion packets in an X-direction and by a drift of the ion packets in the Z-direction, wherein the ion packets are received by said receiver upon conclusion of travel along the jigsaw trajectory, wherein said periodic spatial modulation Z-directionally focuses the ion packets, and wherein said periodic spatial modulation is achieved by periodic openings in at least one of said electrodes.

12. The apparatus as defined in claim 11, wherein said at least one of said ion mirrors comprises two adjacent mirror electrodes and an auxiliary electrode residing between said two adjacent mirror electrodes, and wherein said periodic openings are formed into said auxiliary electrode.

13. The apparatus as defined in claim 12, wherein said adjacent mirror electrodes each have an elongated opening, each of said elongated openings having a Y-directional opening height and extending Z-directionally at least partially across its corresponding said adjacent mirror electrode, and wherein said periodic openings each have a Y-directional height equal to said Y-directional opening height of said elongated openings.

14. The apparatus as defined in claim 12, wherein a Z-directional spacing between said periodic openings is equal to an ion advance in the Z-direction per one mirror reflection.

15. The apparatus as defined in claim 12, wherein a Z-directional spacing between said periodic openings is equal to an ion advance in the Z-direction per two mirror reflections, and wherein said adjacent mirror electrodes each have an elongated opening, each of said elongated openings having a Y-directional opening height and extending Z-directionally at least partially across its corresponding said adjacent mirror electrode, and wherein said periodic openings each have a Z-directional width larger than said Y-directional opening height of said elongated openings.

16. The apparatus as defined in claim 12, wherein a potential applied to said auxiliary electrode differs from a middle potential between said adjacent mirror electrodes.

17. The apparatus as defined in claim 12 and further comprising a deflecting field for reverting ion path in the drift Z-direction, wherein potentials applied to said auxiliary electrode generates said deflecting field.

18. The apparatus as defined in claim 3, wherein said periodic feature has a period equal to integer number of trajectory periods of the ion packets.

19. The apparatus as defined in claim 3, wherein said periodic feature has a period equal to $N*\Delta Z/2$, where N is an integer and $\Delta Z$ is an advance of the ion packets in the drift Z-direction per reflection.

20. The apparatus as defined in claim 4, wherein said periodic feature has a period equal to integer number of trajectory periods of the ion packets.

21. The apparatus as defined in claim 4, wherein said periodic feature has a period equal to $N*\Delta Z/2$, where N is an integer and AZ is an advance of the ion packets in the drift Z-direction per reflection.

22. The apparatus as defined in claim 5, wherein said periodic feature has a period equal to integer number of trajectory periods of the ion packets.

23. The apparatus as defined in claim 5, wherein said periodic feature has a period equal to $N*\Delta Z/2$, where N is an integer and $\Delta Z$ is an advance of the ion packets in the drift Z-direction per reflection.

24. The apparatus as defined in claim 1, wherein the plurality of mask windows are periodically spaced along the drift Z-direction of the auxiliary electrode at a period equal to a Z-direction advance of the ion packets per one reflection between the ion mirrors.

25. The apparatus as defined in claim 1, further comprising:

an orthogonal accelerator residing in the field-free region, wherein the orthogonal accelerator is arranged to collect ions from the pulsed ion source and direct the ions toward one of the ion mirrors as a Z-elongated bunch of ions, wherein each of the plurality of mask windows forms in an Z-Y plane of the auxiliary electrode, and wherein the Z-directional length of each of the plurality of mask windows is sized to pass the Z-elongated bunch of ions.

26. A multi-reflecting time-of-flight mass spectrometer comprising:

a first electrostatic ion mirror extended along a drift Z-direction comprising a set of parallel electrodes;

a second electrostatic ion mirror extended along a drift Z-direction comprising a set of parallel electrodes, wherein the second electrostatic ion mirror is substantially parallel to and spaced apart in an X-direction from said first electrostatic ion mirror;

a field-free region between the first and second ion mirrors;

an ion source arranged to inject ion packets into said field-free region, such that the ion packets are reflected between said first and second ion mirrors; and a receiver to receive the ion packets, wherein said set of parallel electrodes of at least one of said first and said second electrostatic ion mirrors comprises a mask window electrode, and wherein an end potential applied to an end of the mask window electrode differs from a main potential applied to a center of the mask window electrode to form a weak Z-directional reflecting field at the end of the mask window electrode.

27. The apparatus as defined in claim 26, wherein the mask window electrode comprises a first portion and a second portion separated from and adjacent to the first portion, and wherein the main potential is applied to the first portion and the end potential is applied to the second portion.

* * * * *